US007992307B2

(12) United States Patent
Smal

(10) Patent No.: US 7,992,307 B2
(45) Date of Patent: Aug. 9, 2011

(54) HAIR CLIPPER WITH MOTORISED CUTTING GUIDE

(75) Inventor: Olivier Smal, Magnee (BE)

(73) Assignee: Babyliss Faco S.A. (BE)

( * ) Notice: Subject to any disclaimer, the term of this patent is extended or adjusted under 35 U.S.C. 154(b) by 588 days.

(21) Appl. No.: 11/994,729

(22) PCT Filed: Jun. 20, 2006

(86) PCT No.: PCT/BE2006/000069

§ 371 (c)(1), (2), (4) Date: Jan. 4, 2008

(87) PCT Pub. No.: WO2007/006106

PCT Pub. Date: Jan. 18, 2007

(65) Prior Publication Data

US 2008/0163495 A1 Jul. 10, 2008

(30) Foreign Application Priority Data

Jul. 7, 2005 (EP) ..... 05447164

(51) Int. Cl.
*B26B 19/00* (2006.01)

(52) U.S. Cl. ..... 30/202; 30/233.5

(58) Field of Classification Search ..... 30/200–202, 30/233.5, 123, 34.05
See application file for complete search history.

(56) References Cited

U.S. PATENT DOCUMENTS

| | | | | | |
|---|---|---|---|---|---|
| 1,753,750 | A * | 4/1930 | McArdle et al. | 30/201 |
| 1,988,199 | A * | 1/1935 | Greco et al. | 30/202 |
| 2,103,418 | A * | 12/1937 | Hagebeuker | 30/202 |
| 2,726,447 | A * | 12/1955 | Maloy | 30/202 |
| 2,809,425 | A * | 10/1957 | Tettis | 30/233.5 |
| 2,911,715 | A * | 11/1959 | Seifert | 30/202 |
| 2,941,293 | A * | 6/1960 | Mazzoni | 30/201 |
| 2,974,412 | A * | 3/1961 | Clark | 30/201 |
| 3,287,805 | A * | 11/1966 | Du Charme | 30/202 |
| 4,845,852 | A * | 7/1989 | Sukow | 30/201 |
| 5,327,648 | A * | 7/1994 | Ullmann | 30/200 |
| 5,669,921 | A * | 9/1997 | Berman et al. | 606/167 |
| 5,810,858 | A * | 9/1998 | Berman et al. | 606/167 |
| 5,898,999 | A * | 5/1999 | Chaouachi et al. | 30/201 |
| 6,497,043 | B1 * | 12/2002 | Jacobsen | 30/34.05 |
| 6,634,104 | B2 * | 10/2003 | Jacobsen | 30/34.05 |
| 6,968,623 | B2 * | 11/2005 | Braun et al. | 30/201 |
| 7,100,283 | B1 * | 9/2006 | Grdodian et al. | 30/34.05 |
| 2003/0204956 | A1 | 11/2003 | Chan | |
| 2007/0227011 | A1 * | 10/2007 | Caric | 30/123 |
| 2007/0251097 | A1 * | 11/2007 | Terry | 30/123 |
| 2010/0083508 | A1 * | 4/2010 | Cheng | 30/201 |
| 2010/0186234 | A1 * | 7/2010 | Binder | 30/34.05 |

FOREIGN PATENT DOCUMENTS

| | | | |
|---|---|---|---|
| EP | 0 484 795 | A1 | 5/1992 |
| EP | 1 510 305 | A1 | 8/2004 |
| EP | 1710055 | A1 * | 10/2006 |
| GB | 4600 | | 10/1911 |
| JP | 06134149 | A * | 5/1994 |
| WO | WO 2004/033164 | A1 | 4/2004 |
| WO | WO 2007006106 | A1 * | 1/2007 |

* cited by examiner

*Primary Examiner* — Jason Daniel Prone

(74) *Attorney, Agent, or Firm* — Reinart Boerner Van Deuren P.C.

(57) ABSTRACT

The invention concerns a hair clipper comprising a device for adjusting the position of a powered cutting guide slaved to an electronic device, automatically adapting the position of said cutting guide based on the option selected by the user.

4 Claims, 4 Drawing Sheets

HAIR CLIPPER WITH MOTORISED CUTTING GUIDE

CROSS-REFERENCE TO RELATED PATENT APPLICATIONS

This patent application is the National Stage of International Application No. PCT/BE2006/000069, filed Jun. 20, 2006, that claims the benefit of European Application No. 05447164.4, filed Jul. 7, 2005.

FIELD OF THE INVENTION

The present invention relates to the area of hairdressing, and in particular to hair clippers having a cutting guide with motorised regulation and driven by a program providing the user with different cutting options.

STATE OF THE ART

Hair clippers with cutting guides allowing to manually regulate the length of cut of the hair are well known from the state of the art. These are usually a guide that the user positions once and for all to a given length of hair, which often remains constant during the entire haircut. The cutting guide is moreover mainly intended for non-professional users who generally find it difficult to estimate the length of cut required on the different parts of the scalp.

AIMS OF THE INVENTION

The present invention aims to provide a clipper having a motorised cutting guide with instructions that allows to automatically adapt the position of the cutting guide depending on the part of the scalp to be processed by means of an electronic device (microprocessor or simply a circuit comprising at least a transistor and/or a diode) for adapting the position of the cutting guide to the part of the scalp processed by the user.

SUMMARY OF THE INVENTION

The present invention discloses a hair clipper with a device for regulating the position of a cutting guide, motorised and driven by an electronic device, which automatically adapts the position of said cutting guide depending on the cutting option selected by the user.

According to the invention, the electronic device is a circuit comprising a transistor and/or a diode.

The clipper preferably comprises pictograms showing the user the options for different haircuts.

As an advantage, said regulation device is incorporated into the housing of said hair clipper.

In addition, said device comprises a shaft connecting said cutting guide to the motor.

The shaft is preferably a worm screw.

DETAILED DESCRIPTION OF THE INVENTION

Figure 1:
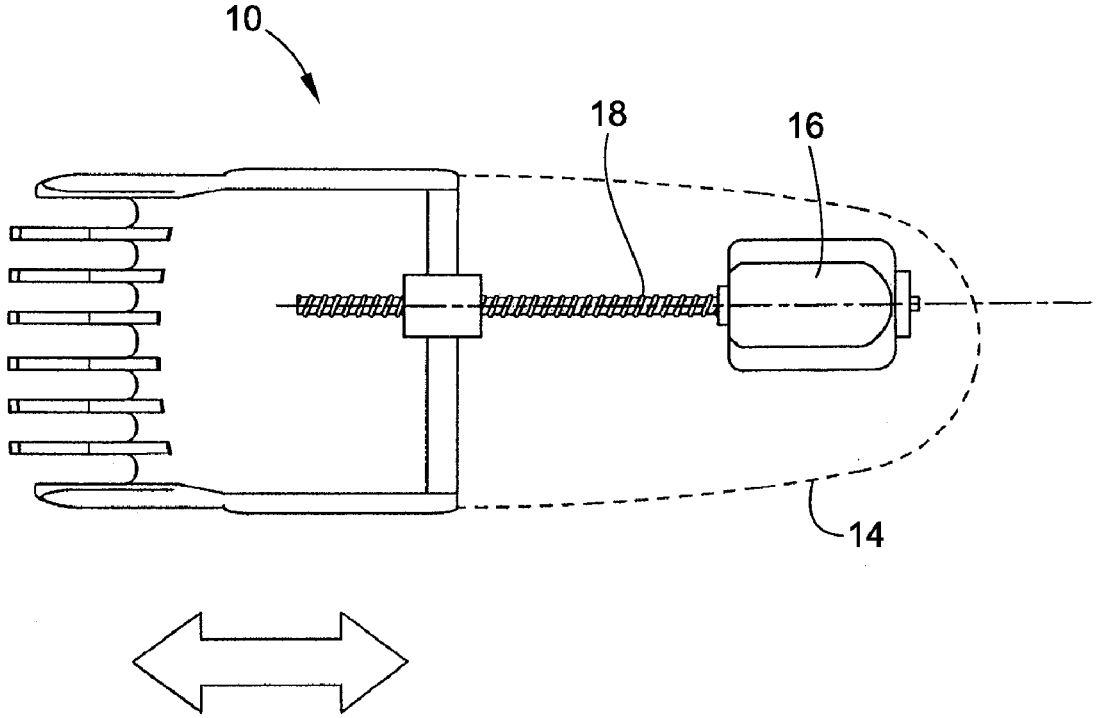
FIG. 1 shows the sketch of a motorised cutting guide incorporated into a clipper.

The motorised cutting guide of the present invention is intended to simplify the use of hair clippers 12 for non-professional users. Inside the housing 14, it comprises a motor 16 connected by a shaft 18 to the cutting guide 10. The cutting guide is driven by the motor 16 which is controlled by a program available via a microprocessor suggesting various options to the user. These options are presented to the user on a screen 22 such as that shown in FIG. 2.

The options suggested to the user include the manual mode and the automatic mode. The manual mode is set by default. The user selects, using at least one button 24 (see FIG. 5), the length of cut by means of the "UP" and "DOWN" buttons from the at least one button 24. The motorised cutting guide 10 then automatically shifts to the desired position.

Figure 2:
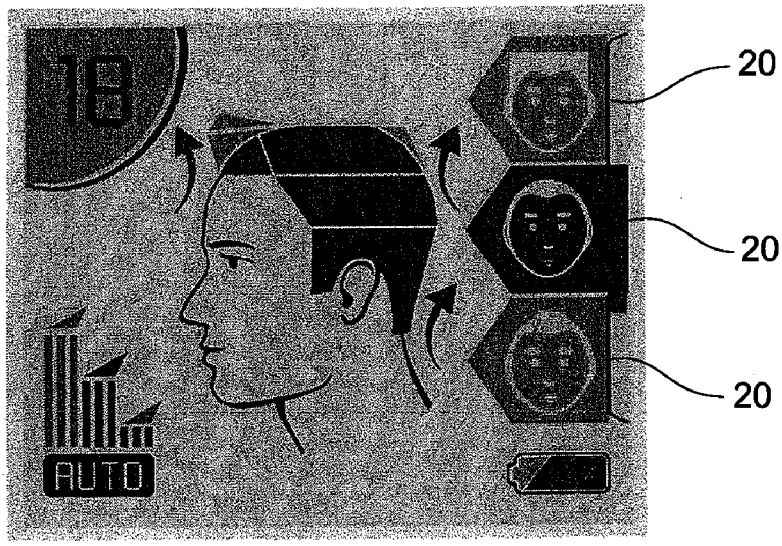
FIG. 2 shows the instructions and the possible options for the user.
Figure 3:
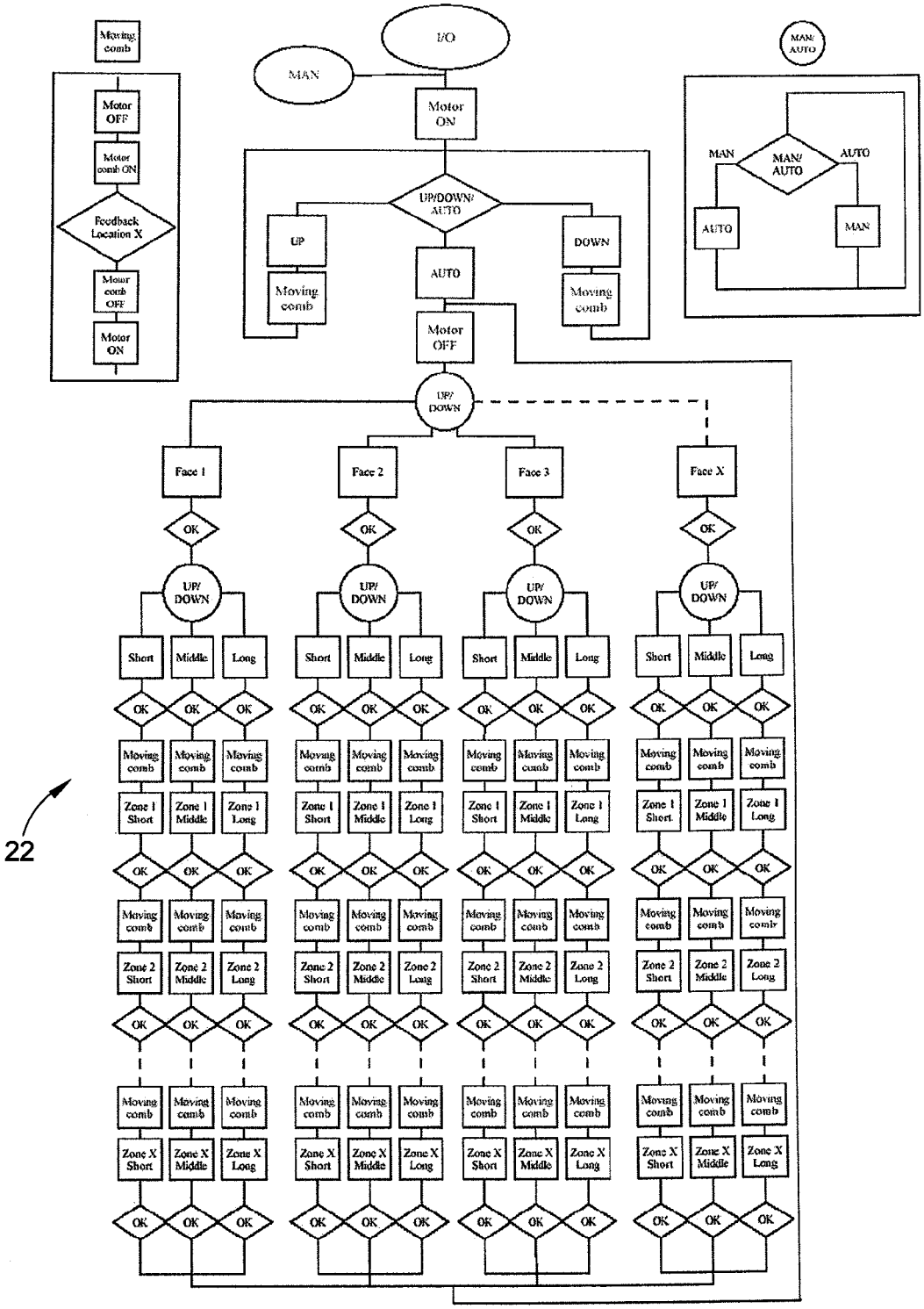
FIG. 3 shows an operation chart of the microprocessor in manual or automatic mode depending on the options selected by the user.
Figure 4:
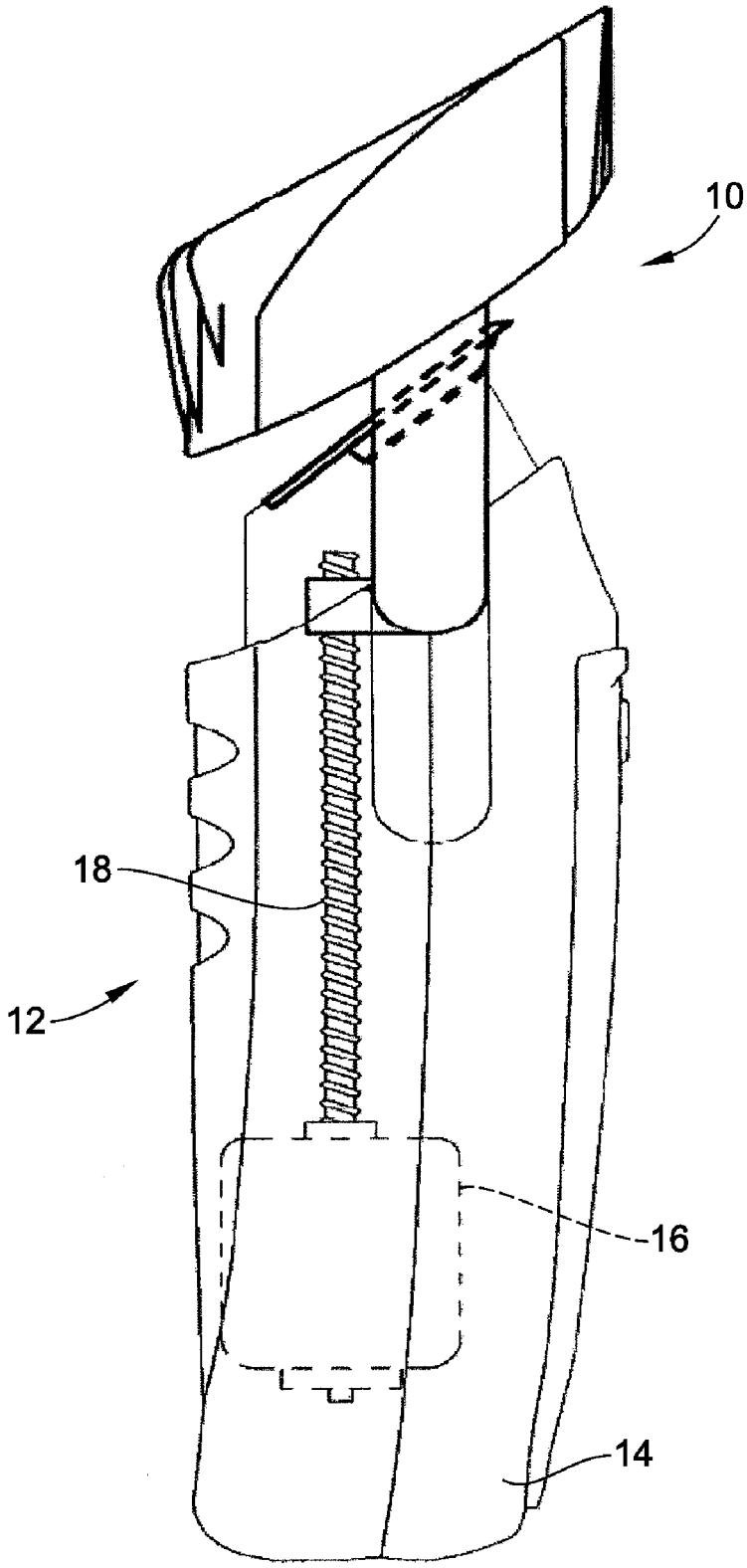
FIG. 4 shows the profile view of a motorised cutting guide incorporated into a clipper.
Figure 5:
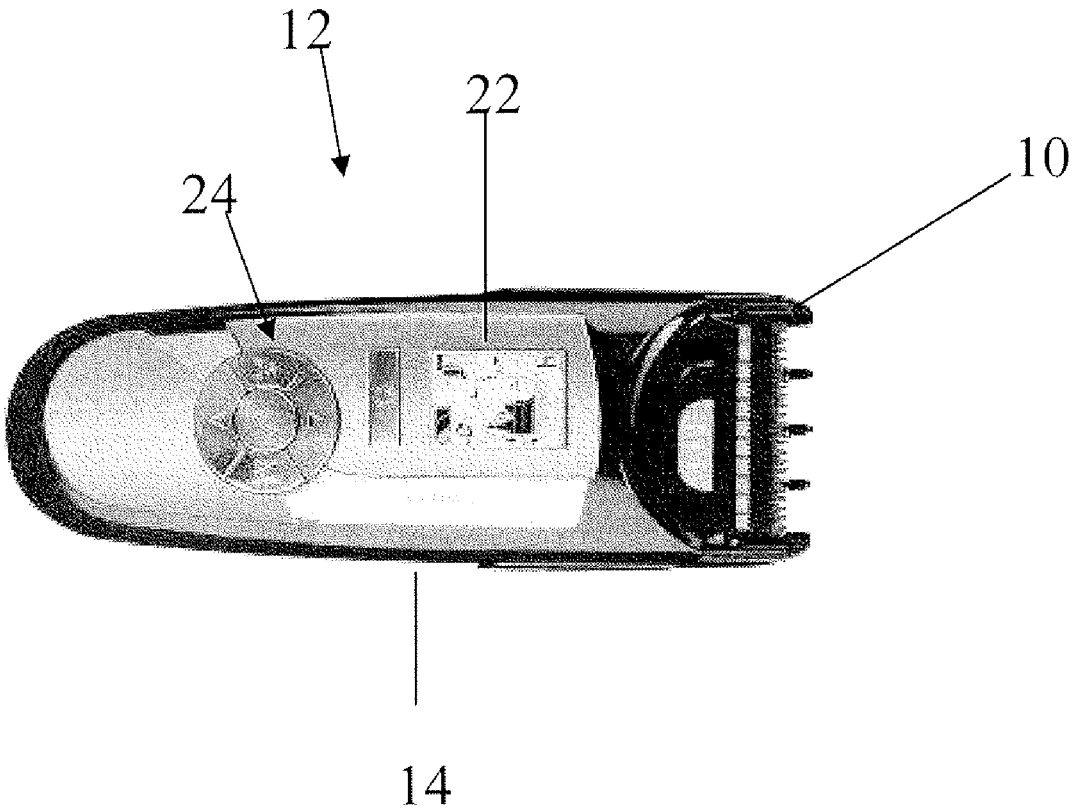
FIG. 5 shows an exemplary embodiment of a clipper according to the teachings of the present invention.

In the automatic mode, the clipper 12 provides the user with various haircut options symbolised by pictograms 20 displayed on screen 22 (see FIG. 2 and FIG. 5). The user selects, using the at least one button 24, the average height of this cut, for example short, medium or long. Lastly, the clipper shifts the cutting guide 10 to the desired height and displays the area of the scalp to be processed. This operating mode allows many combinations of length of haircut, providing many possible hairstyles.

The invention claimed is:

1. A hair clipper comprising:

a cutting guide movable to a plurality of guide positions;

a device for regulating the plurality of guide positions, wherein the device includes a motor that is driven by an electronic device;

a screen;

a first set of pictograms and a second set of pictograms displayed on the screen;

each one of the first set of pictograms being a haircut option;

a user interface including at least one button for selecting one of the hair cut options;

the second set of pictograms being a plurality of segmented regions of a scalp to be processed based on which one of the haircut options is selected;

wherein each one of the plurality of segmented regions of a scalp corresponds to one of the plurality of guide positions; and wherein the electronic device is in communication with the user interface to automatically move the cutting guide to at least one of the plurality of guide positions based on which one of the haircut options was selected via the user interface.

2. The hair clipper of claim 1 further comprising a housing incorporating the device for regulating.

3. The hair clipper of claim 1 wherein the device for regulating comprises a shaft connecting the cutting guide to the motor.

4. Hair clipper as in claim 3, wherein the shaft is a worm screw.

* * * * *